United States Patent [19]

Fortunko

[11] Patent Number: 4,711,152

[45] Date of Patent: Dec. 8, 1987

[54] APPARATUS FOR TRANSMITITNG DATA TO A PROJECTILE POSITIONED WITHIN A GUN TUBE

[75] Inventor: Chris M. Fortunko, Newport Beach, Calif.

[73] Assignee: Aerojet-General Corporation, La Jolla, Calif.

[21] Appl. No.: 925,280

[22] Filed: Oct. 30, 1986

[51] Int. Cl.[4] ..... F42C 17/00

[52] U.S. Cl. ..... 89/6.5

[58] Field of Search ..... 89/6.5; 102/200, 206, 102/215, 270

[56] References Cited

U.S. PATENT DOCUMENTS

| | | | |
|---|---|---|---|
| 4,318,342 | 3/1982 | Chandler | 89/6.5 |
| 4,454,815 | 6/1984 | Beck | 89/6.5 |
| 4,649,796 | 3/1987 | Schmidt | 89/6.5 |

*Primary Examiner*—Charles T. Jordan
*Attorney, Agent, or Firm*—Leonard Tachner

[57] ABSTRACT

An apparatus for transmitting data from the exterior of a gun tube to a projectile positioned within the gun tube utilizes at least two electromagnetic-acoustic transduction devices, one such device positioned on or near the exterior periphery of the gun tube and one such device positioned on or near the interior periphery of the gun tube within the bore. Such data may be used to update target or trajectory information used by a projectile. Transmission of such data, at high data rates, just prior to firing the projectile from the gun tube, enhances the probabiity of target kill or damage. High data rates, compatible with SMART projectile requirements, are made possible by ultrasonic signal frequencies in the range of about 500 Khz to about 2,500 Khz. Phase-shift-keyed modulation may be employed to impart data onto the ultrasonic signals.

20 Claims, 12 Drawing Figures

APPARATUS FOR TRANSMITITNG DATA TO A PROJECTILE POSITIONED WITHIN A GUN TUBE

BACKGROUND OF THE INVENTION

1. Field of the Invention

The present invention relates generally to the field of ordnance and more specifically, to the field of gun tube launched projectiles for which it may desirable or necessary to transmit data to the projectile, such data relating to characteristics of the target or characteristics of the flight path after launch, the projectile receiving such data signals while it is positioned in the gun tube just prior to firing.

2. Prior Art

Typically, the scenario involving a target and a projectile to be fired at the target involves some variable parameters that need to be taken into account in order to improve the target kill probability. Thus for example, artillery shells which utilize proximity detecting fuzes may be more optimally effective by adjusting the fuze characteristics at the last possible moment before firing. There are numerous other types of projectiles that may benefit from such capability. By way of example, there are so-called "smart" projectiles that use an infrared sensor for terminal guidance. There are circumstances under which it would be highly advantageous to transmit to the projectile a set of reference data describing the characteristics of the target just prior to firing the projectile. Transmission of such data to the projectile immediately prior to the ignition of the propulsion charge which, for example, may be used to expel the smart projectile from the gun tube, helps to assure optimum performance of the projectile. Another example is that of an artillery round that may be guided to the target by means of signals generated by the so-called "GLOBAL POSITIONING (GPS) satellite". Immediately prior to firing, a smart GPS guided round must be provided with the latest reference trajectory data, target coordinates, meteorological information and the like. Yet another example involves the use of so-called "smart multipurpose tank rounds" which can be used against a variety of targets. Depending on the target characteristics, different information must be transmitted to the projectile immediately prior to firing.

An example of prior art of substantial relevance to the present invention in that it relates to means for transmitting data directly to a projectile while it is positioned in the gun tube, relates to the manufacture of electronically programmable ordnance fuzes by Thorn EMI Electronics Ltd., of Middlesex, England. However, it is believed that this device is implemented using a conically configured induction coil which is placed over the nose or forward portion of the projectile before it is placed in the gun tube. Unfortunately, such a scheme is not conducive to the transmission of high data rates to the electronics package within the projectile immediately prior to firing. Such a system may be marginally adequate for setting simple fuzes, however, they would be entirely impractical for use in transmitting data to more sophisticated projectiles which require data to be transferred at rates many orders of magnitude greater than the prior art. By way of example, it is contemplated that the aforementioned infrared sensor terminal guidance projectile would require several thousand bits of data to be transferred within a few tens of milliseconds and the aforementioned smart GPS guided round would require in excess of 20,000 bits of data within a few tens of milliseconds. The applicant herein knows of no prior art system which possesses the capability of transferring data to a projectile positioned within a gun tube at data rates which would come even close to those required for sophisticated projectiles. However the need for such a capability increases with the sophistication of smart projectiles that are either currently being placed in the arsenal or are in the planning and design stage and are likely to be implemented in the near future.

SUMMARY OF THE INVENTION

The present invention relies on the principle of electromagnetic-acoustic transduction (EMAT) of ultrasonic signals. The present invention utilizes transducers capable of operating on this principle to transmit data through the gun tube to electronics located within the projectile. A plurality of such transducers can be provided. At least one such transducer serves as an EMAT transmitter and at least one such transducer serves as an EMAT receiver. Typically, in order to avoid the need for precise indexing of the projectile within the gun tube, a plurality of EMAT transmitter transducers is provided and these are spaced symmetrically about the exterior periphery of the gun tube. Normally, one EMAT receiver transducer is provided within the projectile adjacent the exterior skin of the projectile. However, more than one such receiver transducer may be provided in order to increase the reliability of data reception.

Typically, the exterior surface of gun tubes to which the transmitter transducer of the present invention is adjacent, is not readily accessible because of the substantial amount of additional gun components that are required to be mounted on the exterior surface or adjacent the exterior surface of the gun tube. Accordingly, a critical characteristic of the present invention is that it be reliable and further that it be adapted to survive the actual firing of the gun through numerous repetitions. Thus, one of the most important features of the present invention is that electromagnetic-acoustic transduction does not require intimate mechanical contact between the transducer and the underlying conductive body, in this case, the gun tube. In fact it will be seen hereinafter that a significant ultrasonic signal magnitude can be transmitted through the gun tube despite the fact that there may be a gap between one or more transducers and the tube surface. Although various EMAT configurations are available, in the present invention the EMATs used both to generate and receive the ultrasonic signals, utilize permanent magnets. Thus, difficult to implement electromagnets are not needed. In a particular embodiment of the present invention that has been reduced to practice, the transmitter EMAT transducer is placed on the outer periphery of the gun tube below the forcing cone or the origin of rifling. The receiving EMAT transducer is attached to the smart projectile. Shear waves are used thereby enabling the system to be useable in the presence of recoil-mechanism fluids because horizontally-polarized shear waves are not dampened at fluid/solid interfaces.

The transmitter EMAT transducer comprises the final stage of a transmitter consisting of a sinusoidal carrier generator typically operating at a frequency of about 0.5 Mhz. to 2.5 Mhz. The output of the sinusoidal carrier generator is phase shift keyed by a serial data train to be transmitted through the gun tube and into the EMAT receiver. The phase shift modulated sinusoidal signal is applied to an extremely high current driver which drives the EMAT transmitter. The EMAT receiver transducer, which is identical in configuration to the transmitter transducer, is connected to a high input impedance preamp which is in turn connected to a phase detector for serial data recovery within the projectile electronics package. In the particular embodiment reduced to practice, the present invention was operated with a 2 Mhz., 50 KiloWatt RF amplifier connected to the transmitter EMAT which was in turn located on the exterior surface of a 120 Millimeter gun tube. The 2 Mhz. shear waves produced signals that were transmitted radially through the gun tube and detected by the receiver EMAT which was located directly below the transmitter EMAT. The particular configuration demonstrated the successful operation of the system in which digital words modulated the transmitted signal applied to the transmitter transducer and wherein the aforementioned digital words were recovered at the EMAT receiver transducer and associated electronics.

OBJECT OF THE INVENTION

It is therefore a principal object of the present invention to provide a means for transmitting high rate data signals through a gun tube whereby to use such signals for controlling one or more characteristics of a projectile located within the gun tube.

It is an additional object of the present invention to provide an ultrasonic signal transmission system for inputting data signal into a projectile located within a gun tube just prior to firing.

It is still an additional object of the present invention to provide an apparatus for initializing smart munitions utilizing the principal of electromagnetic-acoustic transduction of ultrasonic signals.

It is still an additional object of the present invention to provide an apparatus for initializing smart munitions utilizing at least two EMAT transducers, one for transmission of data and one for reception of data, the transmitter transducer being located on or adjacent the exterior surface of the gun tube and the receiver transducer being located on or adjacent the outer skin of a projectile located within the gun tube whereby to provide updating data signals to the projectile electronics just prior to firing for improving the target kill probability of the weapon system.

It is still an additional object of the present invention to provide an apparature for initializing smart munitions located within the bore of the gun tube and utilizing at least two EMAT transducers at an ultrasonic frequency sufficiently high to enable data transmission rates exceeding 1,000 bits of data per millisecond and wherein the transmitter EMAT transducer need not be located in intimate contact with the exterior surface of the gun tube which would otherwise inimically affect the reliability and durability of the transmitter transducer.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings in which.

DETAILED DESCRIPTION OF A PREFERRED EMBODIMENT

Figure 1:
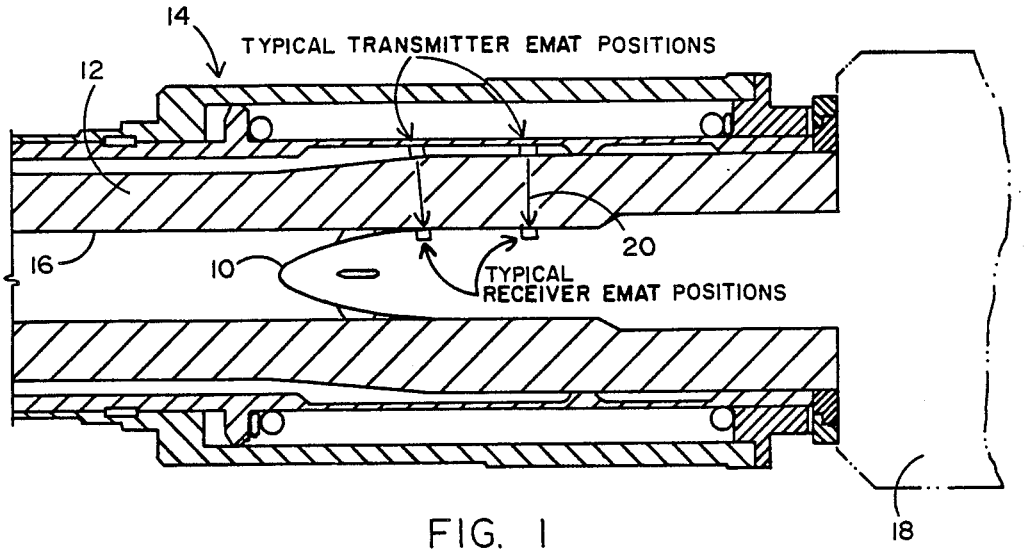
FIG. 1 is a partially cross-sectioned view of a gun system having a smart projectile located within the gun tube bore and positioned for firing.

An exemplary embodiment of the invention is illustrated in FIG. 1. In FIG. 1 it is seen that a projectile 10 is mounted within the gun tube 12 of a gun system 14. The projectile is in its firing position ready for immediate ejection from the gun tube barrel or bore 16 in a substantially conventional manner. The projectile has been placed in this position by a gun breach 18, the detailed structure of which does not form part of the present invention and which therefore need not be described herein in any detail. In the embodiment of the invention illustrated in FIG. 1 there is one transmitter EMAT transducer shown positioned on the exterior surface of the gun tube in two possible positions and radially displaced from the exterior surface of the projectile by a distance substantially equal to the radial thickness of the gun tube. In addition, there is one corresponding receiver EMAT transducer located on or adjacent to the exterior skin of the projectile in substantial radial alignment with the transmitter EMAT transducer in either location. The EMAT transducer on the exterior surface or adjacent the exterior surface of the gun tube are designed to provide a relatively high frequency (i.e approximately 500 Khz to 2.5 Mhz), the ultrasonic signal traveling substantially along the direction of the arrows 20 toward the receiver EMAT transducer and through the solid metal structure of the gun tube. Similarly, the receiver EMAT transducer is designed to respond to the ultrasonic signals transmitted through the gun tube by generating a voltage proportional to the current induced in the receiver EMAT by the radially transmitted ultrasonic signal.

The nature of the electronics connected to both the transmitter EMAT transducer and the receiver EMAT transducer may vary considerably depending upon the nature of the transmission from the exterior of the gun tube to the projectile. One example of such electronics is shown in block diagram form in FIG. 12 which shall be discussed hereinafter. However, it will be readily apparent to those having skill in the relative art that transmission of ultrasonic signals through the gun in the manner herein described, particularly at a high frequency of 0.5 to 2.5 Mhz, provides the opportunity for high rate data transmission to the gun tube positioned projectile for control of the various parameters associated with increasing the probability of target kill or the effectiveness of target damage and in particular establishes a novel and innovative communication link for the initialization and/or fusing of gun launched projectiles.

Figure 2:
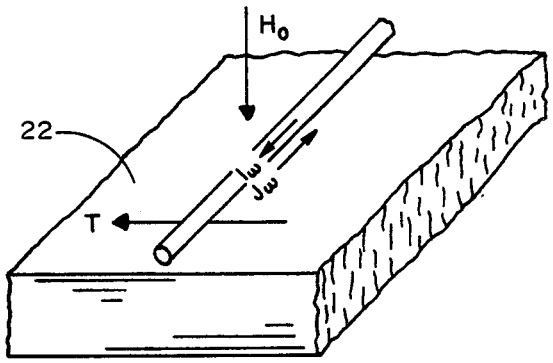
FIG. 2 is a schematic illustration used to explain the principal of electromagnetic-acoustic transduction of ultrasonic signals.
Figure 3:
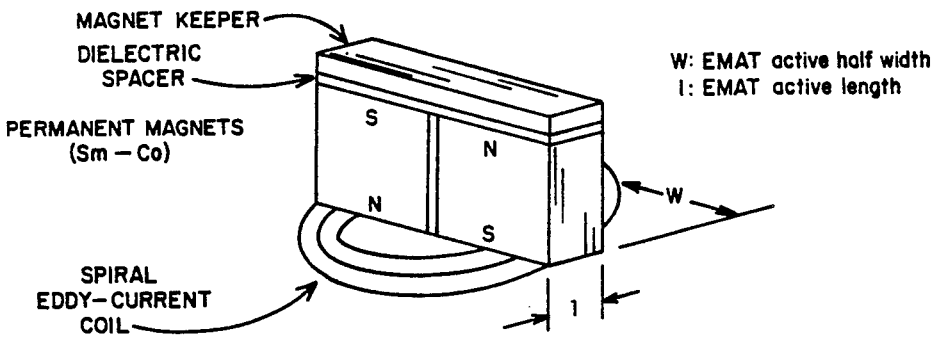
FIG. 3 illustrates the configuration of a typical EMAT transducer.
Figure 4:
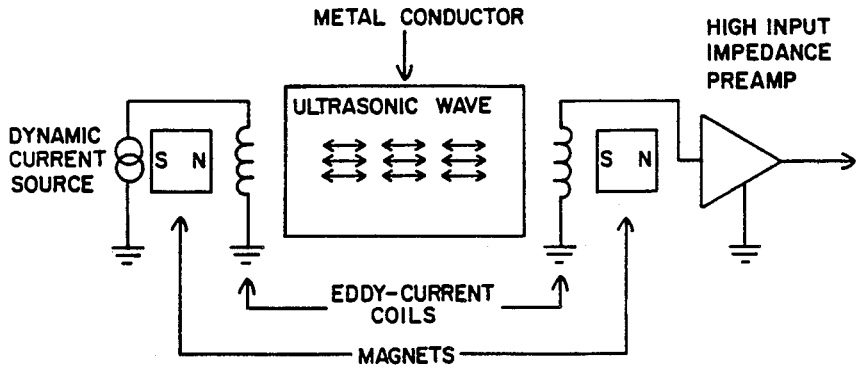
FIG. 4 is a simplified schematic illustrating the principle of ultrasonic wave transmission through a metal conductor utilizing a pair of EMAT transducers.

The principle of electromagnetic-acoustic transduction of ultrasonic signals may be best understood by reference to FIGS. 2–4. FIG. 2 shows a primitive EMAT element composed of a wire conductor carrying a dynamic current $I_\omega$and a source of strong magnetic bias field $H_0$. The current $I_\omega$induces dynamic eddy currents $J_\omega$in the metal conductor surface 22. The strong magnetic bias field $H_0$ causes the deflection of the moving electrons in a direction defined by the cross product of the direction vectors associated with $J_\omega$and $H_0$. The resultant Lorentz body forces T generate ultrasonic signals which propagate radially in the bulk of the metal conductor 22 away from the wire. The signal polarization depends upon the direction of the static bias field $H_0$ with respect to the free surface. Waves with particle displacements parallel to the free surface are called SH waves. The primitive transducer element of FIG. 2 is not very useful in a practical application. It is not very efficient, because of the practical difficulties of efficiently matching isolated wire radiators to transmitter-amplifiers and receiver-preamplifiers in the frequency band used in high rate data transmission. A practical EMAT transducer configuration is illustrated in FIG. 3. This configuration is suitable for transducers used for either transmission or reception of ultrasonic signals. The EMAT transducer of FIG. 3 comprises a two element array of high strength summarium cobalt permanent magnets and a spiral wire coil placed beneath the magnet assembly. A magnetic keeper is placed across the two Samarium-cobalt permanent magnets to provide a magnetic field conduction path between the opposing pole surfaces of the magnets. Dielectric spacers are provided between the magnets and between the magnets and the keeper to reduce eddy current losses. In a particular EMAT configuration that has been reduced to practice for use with the present invention, each spiral eddy current coil is approximately ½ inch in diameter and comprises 50 turns of 32 gauge wire.

Figure 5:
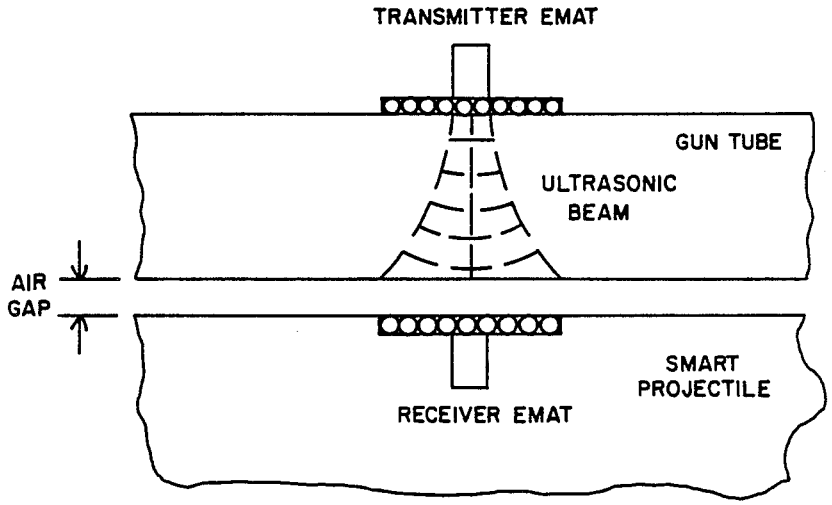
FIG. 5 is a schematic illustration of the gun tube configuration of the present invention illustrating the beam characteristic thereof.
Figure 7:
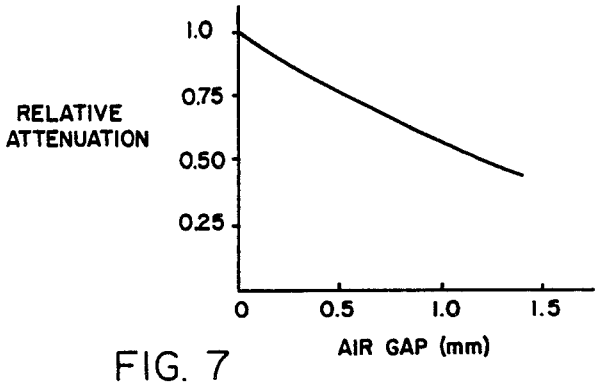
FIG. 7 is a graphical illustration indicating the feasibility of using the present invention despite the presence of an air gap between a transducer and the metal conductor between receiver and transmitter.

The principle of the EMAT based data link system of the present invention is illustrated in FIG. 4. In FIG. 4 there is shown an EMAT transmitter having its eddy current coil connected in series with the dynamic current source and an EMAT receiver having its eddy current coil connected in series with the input to a high input impedance preamplifier. A metal conductor (the gun tube in the particular embodiment disclosed herein) provides an ultrasonic wave transduction medium. FIG. 5 illustrates the nature of the ultrasonic beam that travels radially through the gun tube from the transmitter EMAT transducer to the receiver EMAT transducer located beneath the external skin of the SMART projectile. As seen in FIG. 5 the eddy current coil of each transducer is located closest to that portion of the gun tube through which the ultrasonic beam passes. In the particular illustrative example depicted in FIG. 5, the transmitter EMAT is shown on the exterior surface of the gun tube but not necessarily in intimate mechanical contact with the gun tube, and the receiver EMAT is shown separated from the gun tube surface interior by a small air gap. As shown in FIG. 7 the relative attenuation of the ultrasonic beam magnitude is slow to deteriorate the signal with increasing air gap length up to about 1.5 millimeters. Consequently, an air gap between each respective eddy current coil of both transducers and the gun tube surface of approximately ½ millimeter will produce only a 50% reduction in signal strength.

Figure 6:
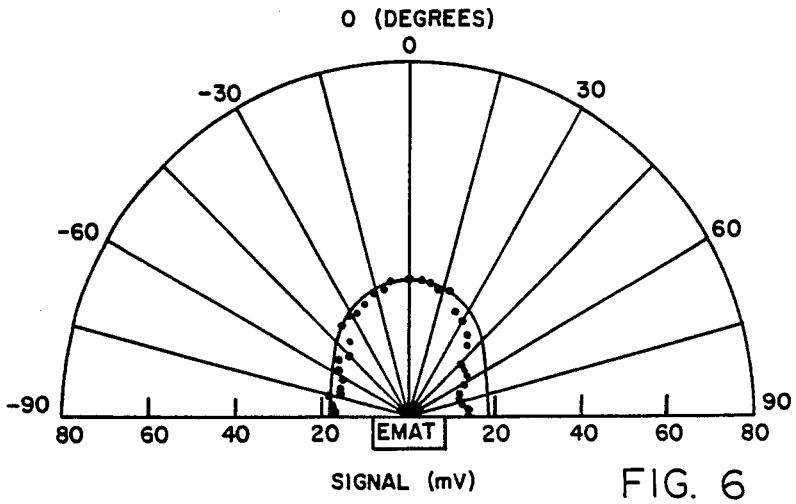
FIG. 6 is graphical illustration of the beam characteristics of the present invention.

Referring again to FIG. 5 it will be seen that the actual EMAT generated ultrasonic beam becomes increasingly spread as it passes radially through the gun tube. An actual ultrasonic beam pattern is shown in FIG. 6 wherein the solid line represents a theoretical beam characteristic and the dots represent actually measured beam parameters as a function of measured signal voltage and angle from the center or axis of the beam. Analysis of FIG. 6 will indicate that the signal strength is substantially constant over + or −15 degrees from the axis of the ultrasonic beam and diminishes only about 15 to 20% over a range of + or −30 degrees from the axis of the beam. Thus, each transmitter EMAT can be used to generate an ultrasonic beam of significant strength over an angular region of approximately 60 degrees along the periphery of the gun tube. Accordingly, by using between 6 to 12 such transmitter EMATs symmetrically spaced around the exterior surface of the gun tube, it is feasible to render the data link system of the present invention entirely independent of projectile radial index position.

Figure 8:
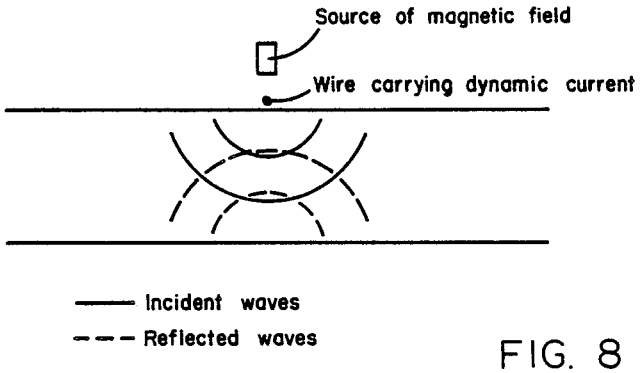
FIG. 8 is a schematic illustration of the reflective wave characteristics of an EMAT.
Figure 9:
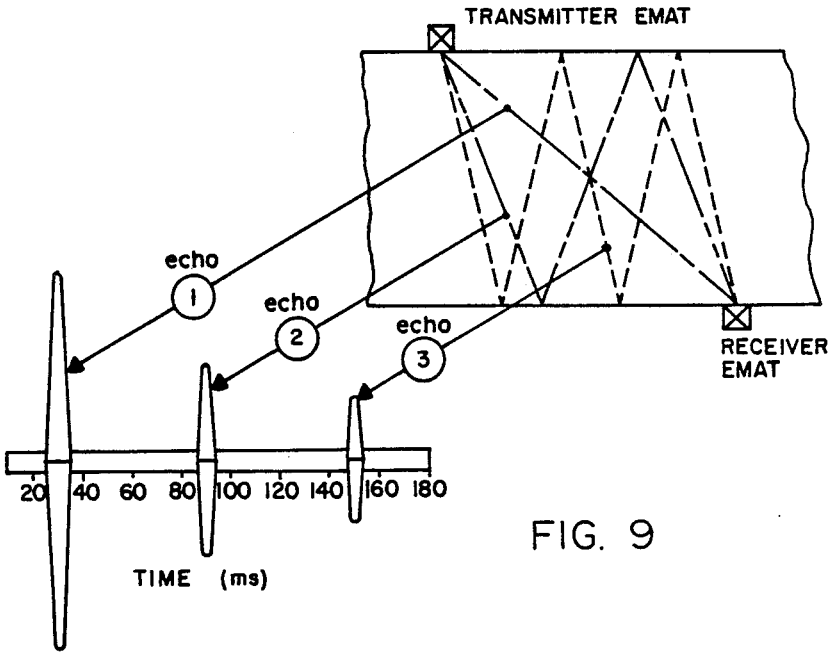
FIG. 9 is a graphical illustration used to explain the echo characteristics of the ultrasonic signals passing between transmitter and receiver EMATs.

One idiosyncrasy of ultrasonic signals that must be taken into consideration in the present invention is the fact that they are reflected by discontinuous surfaces. Thus, as indicated in FIG. 8, the ultrasonic signal transmitted by the EMAT transmitter transducer tends to reflect from the inner surface of the gun tube, that is, the gun tube bore, traveling back towards the outer surface of the gun tube where it again reflects each such reflection being attenuated in proportion to the distance traveled through the gun tube. Thus, as indicated in FIG. 9, a receiver EMAT will sense a multitude of transmitter signals or echos depending upon the path of the transmitted ultrasonic beam. Thus for example, as shown in FIG. 9, echo 1 is the signal sensed by the receiver EMAT based on a direct travel path between the transmitter EMAT and receiver EMAT. However a second signal indicated in FIG. 9 as echo 2 will be received by the receiver EMAT as a result of the ultrasonic signal bouncing off the inner surface of the gun tube and the outer surface of the gun tube before reaching the receiver EMAT. As a result, echo 2 is attenuated and delayed in time relative to the echo 1 signal first received by the EMAT transducer. Similarly, a third signal identified in FIG. 9 as echo 3 will result from the double reflection of the ultrasonic beam off of the inner surface of the gun tube and the outer surface of the gun tube before reaching the receiver EMAT. As seen in FIG. 9 this signal is further delayed and further attenuated relative to the directly transmitted signal.

Figure 10:
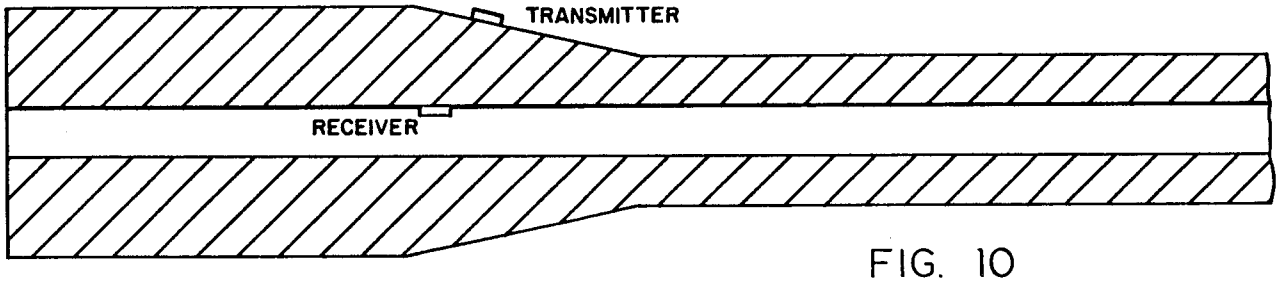
FIG. 10 is a cross-sectional view of a typical tank main gun tube profile illustrating possible transmitter and receiver locations that may be used on the present invention for improving signal characteristics.
Figure 11:
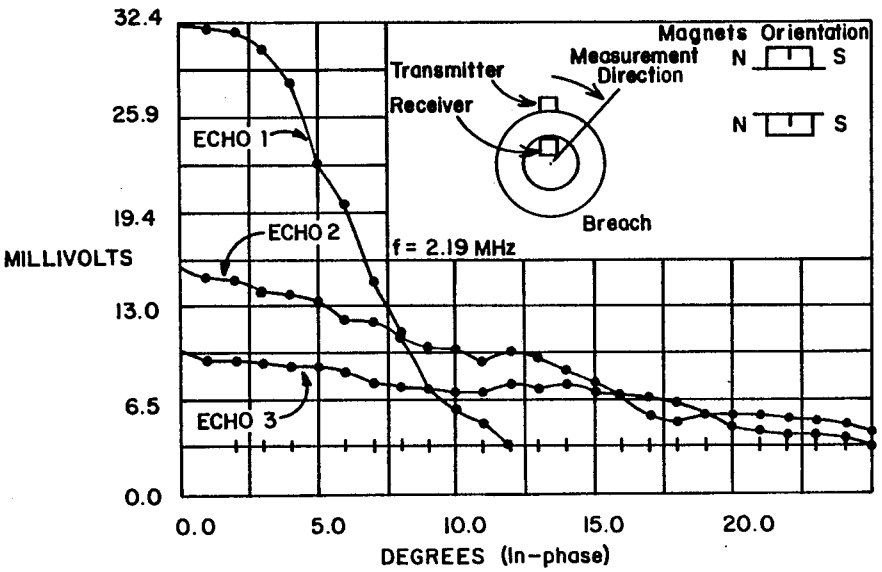
FIG. 11 is a graphical illustration indicating the relative signal strengths of the various signals of FIG. 9 actually measured through a gun tube.

One potential solution to this multiple echo characteristic is to vary the relative axial positions of the transmitter and receiver EMAT transducer as shown in FIG. 10 and furthermore, where possible, to take advantage of available geometric characteristics of the gun tube surface exterior to increase the path link and thus the attenuation of multiple echos. Another potential solution to the aforementioned multiple echo characteristic is to set a minimum signal threshold level in the electronics portion of the projectile receiver circuit, whereby to cause the secondary echos to be ignored by the receiver because of their relative attenuation compared to the principal signal. Thus for example, FIG. 11 indicates the measured signal strengths in millivolts of the three signals shown in FIG. 9 measured along the interior surface of the gun tube in the direction indicated in FIG. 11. Thus for example, if for the configuration of EMATs represented by the graph of FIG. 11, a minimum threshold level of approximately 16 millivolts were utilized in the receiver electronics contained within the projectile, the reflected signals echo 2 and echo 3 would be substantially ignored by the circuit. However, such threshold limiting would decrease the effective angular range of each EMAT transmitter transducer to approximately + or −7 degrees and as a result, the number of EMAT transducers required to make the system relatively insensitive to the rotational configuration of the projectile would be approximately 26.

The preferred solution to the multiple echo characteristic of the present invention is likely to depend upon the time delay between the respective signals such as ECHO 1, ECHO 2 and ECHO 3 of FIG. 9 seen by the receiver EMAT. More specifically, as shown in FIG. 9, there is an approximate time delay of 60 milliseconds between ECHO 1 and ECHO 2 and all additional ECHOs are of course, even further delayed with respect to the first signal ECHO 1. Accordingly, it may be found preferable to utilize a time gating feature in the receiver electronics which limits the reception period for any one signal to approximately 50 milliseconds. Such gating may be initiated by some preliminary event such as receipt of first signal after predetermined hiatus or after receipt of first signal exceeding a minimum threshold level such as 20 or 25 millivolts for the EMAT characteristic represented by the Table in FIG. 11.

Still another solution which may be preferably, is to combine threshold and time gating features so that the period of time in which the receiver electronics must be made insensitive to incoming signals is limited to permit compliance with high data rate transmission requirements of the system. Thus for example, in the specific illustration of FIGS. 9 and 11, receiver electronics may be provided to effectively "filter out" the ECHO 2 and ECHO 3 signals by utilizing time gating for passing the first 50 milliseconds of signal after receipt of first signal or receipt of first signal above threshold and by then using threshold circuitry to effectively "filter out" higher order echo signals without precluding reception of the principal signal of a new transmission. Thus for example, such a combination of threshold and time filtering would permit the system to be in a reception mode for about 50 milliseconds out of each 120 milliseconds which would yield a transmitter duty rate of approximately 41.67%. In any case, those of ordinary skill in the art to which the present invention pertains will recognize that numerous means are available to overcome the reflective characteristics of the ultrasonic signal reflections while providing a reliable high rate data link and permitting use of only a modest number of transmitter/transducers to make the system relatively insensitive to projectile index position.

Figure 12:
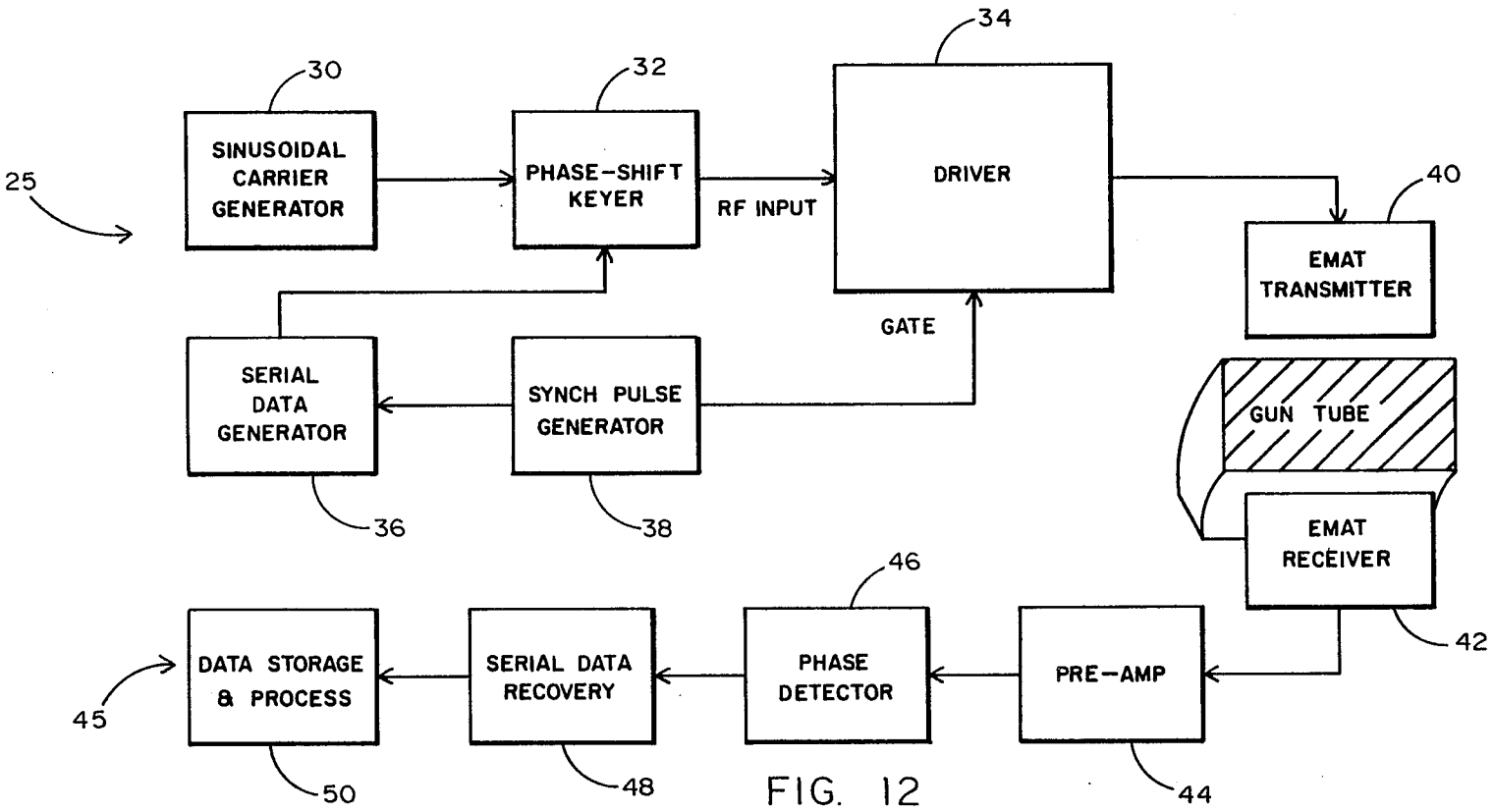
FIG. 12 is a block diagram of an illustrative data transmission scheme utilizing the present invention.

Reference will now be made to FIG. 12 which indicates more completely the constituent components of the transmitter and receiver, respectively, of the present invention. More specifically, referring now to FIG. 12, it will be seen that the transmitter portion 25 of the present invention comprises a sinusoidal carrier generator 30, a phase shift keyer 32, a driver 34, a serial data generator 36 and a synch pulse generator 38, all of which are connected through the driver to the EMAT transmitter/transducer 40. In preferred embodiments of the present invention, the frequency of sinusoidal carrier generator 30 is typically between 0.5 Mhz and 2.5 Mhz. However, carrier frequencies above and below that range are not to be deemed to be excluded from the scope of the invention. The frequency of the carrier signal utilized in the test for producing the data of the table of FIG. 11 was 2.19 Mhz. The actual frequency selected as the output of the carrier generator 30 is based upon an engineering trade-off between data transmission bandwidth and signal-to-noise ratio requirements on the one hand (the latter being at least partially dependent upon the configuration of the gun tube and the characteristics of the receiver electronics utilized in the projectile) and mechanical alignment and EMAT drive electronics requirements on the other hand. Generally speaking, the higher data rates require broader bandwidths and therefore, higher carrier frequencies, however, higher carrier frequencies tend to cause greater attenuation levels of the ultrasonic signal away from the beam axis between the outer and inner surface of the gun tube and therefore detrimentally affect the transducer alignment and number of required transmitter transducers.

Phase shift keyer 32 provides a means for modulating the output of sinusoidal carrier generator 30. Phase shift keyer 32 operates by shifting the phase of the incoming carrier signal by 180 degrees or not shifting its phase at all depending upon the corresponding individual serial bit generated by the serial data generator 36. Of course, the invention is not limited to phase shift keying modulation. Other forms of modulation may be readily applied such as amplitude modulation, frequency modulation, pulse modulation, and pulse code modulation. However, phase shift keying modulation may be preferred because it minimizes the heat dissipated by allowing the transmitter driver to run at full power at all times. The synch pulse generator 38 may be used to synchronize the output of serial data generator 36 and the driver 34 such as for rendering the system relatively insensitive to higher order echo signals as previously described. Driver 34 is a high current amplifier capable of drive currents in excess of 100 amperes. The basic schematic of a power amplifier for a transmitter EMAT is shown in FIG. 5–5*a* of NBS Technical Note 1075 entitled Electromagnetic-Acoustic-Transducer/Synthetic-Aperture System For Thick Weld Inspection published by the U.S. Department of Commerce/National Bureau of Standards in May 1984 and written by Messers. Fortunko, Schramm, Moulder and McColskey.

The output of the driver 34 is applied to the EMAT transmitter/transducer 40 which is positioned either in contact with or in close proximity to the exterior surface of the gun tube as previously described. The interior surface of the gun tube is similarly in contact with or in proximity to the EMAT receiver/transducer 42 of receiver 45. The output of the EMAT receiver/transducer is connected to a preamplifier 44 which is designed primarily to provide the required impedance to the receiver/transducer to preserve signal-to-noise ratio and optimize signal transfer to the remainder of the receiver circuit. Typically, the preferred preamplifier exhibits noise levels equivalent to a resistance of 62.5 Ohms while typical EMAT resistances lie in the range of 1.5 to 7 Ohms. Examples of appropriate preamplifiers for use in the present invention are illustrated in FIGS. 5-2 and 5-3, respectively, in the aforementioned National Bureau of Standards publication. The output of the preamplifier 44 is applied to a phase detector 46 designed to recover the phase shift modulation from the carrier signal received by the transducer. Serial data recovery circuits 48 then enhance the pulse shapes of the recovered data and transmit the same to the data storage and process circuits 50, the specific implementation of which may vary depending upon the nature of the parameters controlled by the data link of the present invention. Typically, the data storage and process circuits comprise a microprocessor and associated firmware for carrying out the control of projectile parameters in response to the transmission of data through the gun tube by means of the present invention.

It will now be understood that what has been disclosed herein comprises a novel apparatus for transmitting data to a projectile positioned within a gun tube. The apparatus comprises at least two electromagnetic acoustic transduction devices referred to herein as EMATs. The EMAT consists of a wire conductor carrying a dynamic current adjacent a high intensity permanent magnetic field which induces eddy currents of ultrasonic frequency in an adjacent metal conducting surface. The eddy currents produce forces in the form of mechanical waves that propagate into the metal conductor. The mechanical waves are transmitted through the conductor, in this case, the wall of a gun tube and as a result induce a voltage in a wire conductor of a second transducer located on the opposite surface of the metal body. It is feasible to transmit high frequency signals through the wall of the gun tube.

An important feature of the principal of electromagnetic acoustic transduction is that intimate mechanical contact is not required between the wire conductor and the metal conducting body. Consequently, it is possible by means of the present invention to transmit relatively high frequency signals through a relatively thick metal body from one transducer to another without one or both such transducers being in contact with the metal body. The EMAT characteristics permit transfer of relatively high frequency information permitting the transmission of high data rate signals which may be modulated onto the mechanical waves in a transmitter connected to one or more of the aforementioned EMAT transducers. The EMAT transducer located in contact with or adjacent to the interior surface of the gun tube, may be positioned on or adjacent the skin of a projectile body located within the gun tube. This receiving transducer is connected to suitable electronics for detecting and demodulating the data stream whereby to transfer data to the projectile positioned within the gun tube just prior to firing. Such data may incorporate various characteristics of the target or of tracking satellites associated with the accuracy of the trajectory of the projectile or with fusing information associated with the detonation characteristics of the projectile in order to increase kill probability.

Although a preferred embodiment of the present invention has been disclosed herein, those having skill in the art to which the present invention pertains will, as a result of the applicant's teaching herein, perceive various modifications and additions to the invention. By way of example, various alternative transmitter and receiver implementations may be readily utilized within the teachings of the invention for altering frequencies, data rates, modulation characteristics, and the like. In addition, higher transmission frequencies are easily obtained if one is willing to work with narrower beams. Furthermore, the transmitter may be other than an EMAT transducer device. For example, laser-beam-induced ultrasonic transmission is quite feasible. However, all such modifications and additions are deemed to be within the scope of the invention which is to be limited only by the claims appended hereto.

I claim:

1. An apparatus for transmitting data to a projectile positioned within the bore of a gun tube; the apparatus comprising:

at least two ultrasonic transducers, a first such transducer positioned adjacent the inner surface of said gun tube within said bore, and a second such transducer positioned adjacent the outer surface of said gun tube;

means for applying a data modulated radio frequency electromagnetic signal to said second transducer for transmitting a corresponding ultrasonic signal from said second transducer to said first transducer through said gun tube; and means connected to said first transducer for demodulating said corresponding ultrasonic signal for use of said data in said projectile.

2. The apparatus recited in claim 1 wherein each said transducer is an EMAT transducer.

3. The apparatus recited in claim 1 wherein at least one of said transducers is separated from said gun tube by an air gap.

4. The apparatus recited in claim 1 wherein said first transducer is positioned on the exterior surface of said projectile.

5. The apparatus recited in claim 1, further comprising a plurality of additional ultrasonic transducers which, in combination with said second transducer, are spaced about the exterior surface of said gun tube.

6. The apparatus recited in claim 1 wherein said first and second transducers are positioned on a radial line which is substantially perpendicular to the axis of said gun tube.

7. The apparatus recited in claim 1 wherein said frequency is in the range of 500 Khz to 2,500 Khz.

8. The apparatus recited in claim 1 wherein said electromagnetic signal is modulated by phase shifting in accordance with the content of said data.

9. The apparatus recited in claim 1 wherein said means for demodulating comprises means for ignoring second reflections of said ultrasonic signal within said gun tube.

10. The apparatus recited in claim 1 wherein said means for applying comprises means for gating said electromagnetic signal on and off for preselected time intervals.

11. An apparatus for updating the target and trajectory parameters of a projectile in a gun tube just prior to firing; the apparatus comprising:

an ultrasonic transmitter transducer located adjacent to the outer peripheral surface of said gun tube;

an ultrasonic receiver transducer located adjacent to the inner peripheral surface of said gun tube;

means for driving said transmitter transducer with a data modulated radio frequency electromagnetic signal for transmitting a corresponding ultrasonic signal through said gun tube to said receiver transmitter; and means in electrical communication with said ultrasonic receiver transducer for extracting said data from said ultrasonic signal and applying said data to said projectile.

12. The apparatus recited in claim 11 wherein each said transducer is an EMAT transducer.

13. The apparatus recited in claim 11 wherein at least one of said transducers is separated from said gun tube by an air gap.

14. The apparatus recited in claim 11 wherein said transmitter transducer is positioned in close proximity to the outer peripheral surface of said gun tube.

15. The apparatus recited in claim 11, further comprising a plurality of additional ultrasonic transducers which, in combination with said transmitter transducer, are spaced about the outer peripheral surface of said gun tube.

16. The apparatus recited in claim 11 wherein said transmitter and receiver transducers are positioned on a radial line which is substantially perpendicular to the axis of said gun tube.

17. The apparatus recited in claim 11 wherein said frequency is in the range of 500 Khz to 2,500 Khz.

18. The apparatus recited in claim 11 wherein said electromagnetic signal is modulated by phase shifting in accordance with the content of said data.

19. The apparatus recited in claim 11 wherein said means for extracting comprises means for ignoring secondary reflections of said ultrasonic signal within said gun tube.

20. The apparatus recited in claim 11 wherein said means for driving comprises means for gating said electromagnetic signal on and off for preselected time intervals.

* * * * *